US006911114B2

(12) United States Patent
Lindsay et al.

(10) Patent No.: US 6,911,114 B2
(45) Date of Patent: Jun. 28, 2005

(54) TISSUE WITH SEMI-SYNTHETIC CATIONIC POLYMER

(75) Inventors: Jeffrey Dean Lindsay, Appleton, WI (US); Thomas Gerard Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 176 days.

(21) Appl. No.: 10/263,023

(22) Filed: Oct. 1, 2002

(65) Prior Publication Data

US 2004/0062907 A1 Apr. 1, 2004

(51) Int. Cl.[7] ..... D21H 17/24; D21H 21/29

(52) U.S. Cl. ..... 162/112; 162/111; 162/164.6; 162/168.2; 162/175; 162/125; 428/152

(58) Field of Search ..... 162/175, 111–112, 162/164.6, 168.2, 125, 127, 129; 428/113, 152, 311.71; 524/47; 536/1.1, 4.5, 18.7

(56) References Cited

U.S. PATENT DOCUMENTS

| | | | | |
|---|---|---|---|---|
| 3,354,034 A | * | 11/1967 | Jarowenko | 162/175 |
| 3,395,708 A | | 8/1968 | Hervey et al. | |
| 3,554,862 A | | 1/1971 | Hervey et al. | |
| 3,554,863 A | | 1/1971 | Hervey et al. | |
| 3,556,932 A | | 1/1971 | Coscia et al. | |
| 3,556,933 A | | 1/1971 | Williams et al. | |
| 3,585,104 A | | 6/1971 | Kleinert | |
| 3,700,623 A | | 10/1972 | Keim | |
| 3,737,370 A | * | 6/1973 | Jarowenko et al. | 162/175 |
| 3,755,220 A | | 8/1973 | Freimark et al. | |
| 3,772,076 A | | 11/1973 | Keim | |
| 3,844,880 A | | 10/1974 | Meisel, Jr. et al. | |
| 3,879,257 A | | 4/1975 | Gentile et al. | |
| 3,885,158 A | | 5/1975 | Flutie et al. | |
| 3,899,388 A | | 8/1975 | Petrovich et al. | |
| 3,916,058 A | | 10/1975 | Vossos | |
| 3,972,855 A | | 8/1976 | Martinsson et al. | |
| 4,028,172 A | | 6/1977 | Mazzarella | |
| 4,069,159 A | | 1/1978 | Hayek | |
| 4,129,528 A | | 12/1978 | Petrovich et al. | |
| 4,144,122 A | | 3/1979 | Emanuelsson et al. | |
| 4,147,586 A | | 4/1979 | Petrovich et al. | |
| 4,158,594 A | | 6/1979 | Becker et al. | |
| 4,222,921 A | | 9/1980 | Van Eenam | |
| 4,255,294 A | | 3/1981 | Rudy et al. | |
| 4,297,860 A | | 11/1981 | Pacifici et al. | |
| 4,314,001 A | | 2/1982 | Wesseler | |
| 4,377,543 A | | 3/1983 | Strohbeen et al. | |
| 4,432,833 A | | 2/1984 | Breese | |
| 4,440,597 A | | 4/1984 | Wells et al. | |
| 4,514,345 A | | 4/1985 | Johnson et al. | |
| 4,528,239 A | | 7/1985 | Trokhan | |
| 4,529,480 A | | 7/1985 | Trokhan | |
| 4,556,450 A | | 12/1985 | Chuang et al. | |
| 4,594,130 A | | 6/1986 | Chang et al. | |
| 4,773,110 A | | 9/1988 | Hopkins | |
| 4,776,965 A | | 10/1988 | Nuesslein et al. | |
| 4,793,898 A | | 12/1988 | Laamanen et al. | |
| 4,795,530 A | | 1/1989 | Soerens et al. | |
| 5,098,522 A | | 3/1992 | Smurkoski et al. | |
| 5,221,435 A | | 6/1993 | Smith, Jr. | |
| 5,230,776 A | | 7/1993 | Andersson et al. | |
| 5,260,171 A | | 11/1993 | Smurkoski et al. | |
| 5,275,700 A | | 1/1994 | Trokhan | |
| 5,328,565 A | | 7/1994 | Rasch et al. | |
| 5,334,289 A | | 8/1994 | Trokhan et al. | |
| 5,336,373 A | | 8/1994 | Scattolino et al. | |
| 5,353,521 A | | 10/1994 | Orloff | |

(Continued)

FOREIGN PATENT DOCUMENTS

| | | |
|---|---|---|
| WO | WO 95/18157 A1 | 7/1995 |
| WO | WO 98/24972 A1 | 6/1998 |
| WO | WO 99/18288 A1 | 4/1999 |
| WO | WO 99/62957 A1 | 12/1999 |
| WO | WO 99/62967 A2 | 12/1999 |
| WO | WO 00/03090 A1 | 1/2000 |
| WO | WO 00/15669 A1 | 3/2000 |
| WO | WO 01/12414 A1 | 2/2001 |
| WO | WO 01/49937 A1 | 7/2001 |
| WO | WO 01/90199 A2 | 11/2001 |
| WO | WO 02/41815 A2 | 5/2002 |

OTHER PUBLICATIONS

Dreshfield Jr., Arthur C. and S.T. Han, "The Drying of Paper," *Tappi*, Technical Section vol. 39, No. 7, Jul. 1956, pp. 449–455.

Foulger, M. et al., "New Technology to Apply Starch and Other Additives," Pulp & Paper Canada, vol. 100, No. 2, 1999, pp. 24–25.

Robertson, A.A., "The Physical Properties of Wet Webs—1. Fiber–Water Association and Wet–Web Behavior," *Tappi*, Technical Section, vol. 42, No. 12, Dec. 1959, pp. 969–978.

Sauve, Christopher, "Raifix: a Novel Chemistry for the Treatment of Coated Broke, " *PAPTEC Annual Meeting*, Montreal, CA, Feb. 1, 2001, pp. 1–4.

Trigylidas, Denni, "The Use of Raifix to Enhance Fines and Filler Retention in Mechnical Goundwood Pulps," a thesis submitted to The University of British Columbia, Aug. 1999, pp. 1–86.

Federal Specification UU–T–595b, "Towel, Wiping, Paper: Industrial And Institutional," Apr. 4, 1967, 8 pages.

Federal Specification UU–T–595c, "Towel, Wiping, Paper: Industrial And Institutional," Jul. 27, 1976, 8 pages.

*Primary Examiner*—José A. Fortuna
(74) *Attorney, Agent, or Firm*—Gregory E. Croft; Patricia A. Charlier

(57) ABSTRACT

The present invention is a tissue web comprising cellulosic fibers and a semi-synthetic cationic polymer having a molecular weight less than about 5 million. The semi-synthetic cationic polymer can be heterogeneously distributed in the tissue web. The semi-synthetic cationic polymer has a degree of cationic substitution of at least 0.2.

19 Claims, 1 Drawing Sheet

U.S. PATENT DOCUMENTS 5,411,636 A 5/1995 Hermans et al.
5,431,786 A 7/1995 Rasch et al.
5,494,554 A 2/1996 Edwards et al.
5,496,624 A 3/1996 Stelljes, Jr. et al.
5,500,277 A 3/1996 Trokhan et al.
5,514,523 A 5/1996 Trokhan et al.
5,554,467 A 9/1996 Trokhan et al.
5,566,724 A 10/1996 Trokhan et al.
5,595,628 A 1/1997 Gordon et al.
5,598,642 A 2/1997 Orloff et al.
5,598,643 A 2/1997 Chuang et al.
5,624,790 A 4/1997 Trokhan et al.
5,628,876 A 5/1997 Ayers et al.
5,637,194 A 6/1997 Ampulski et al.
5,656,132 A 8/1997 Farrington, Jr. et al.
5,672,249 A * 9/1997 Vinson et al. ..... 162/111
5,772,845 A 6/1998 Farrington, Jr. et al.
5,840,403 A 11/1998 Trokhan et al.
5,855,739 A 1/1999 Ampulski et al.
5,865,950 A * 2/1999 Vinson et al. ..... 162/112
5,897,745 A 4/1999 Ampulski et al.
5,906,894 A * 5/1999 West et al. ..... 428/507
5,935,383 A 8/1999 Sun et al.
5,944,954 A * 8/1999 Vinson et al. ..... 162/111
5,948,507 A 9/1999 Chen et al.
5,958,178 A 9/1999 Bartsch et al.
5,958,558 A 9/1999 Giesfeldt et al.
5,990,377 A 11/1999 Chen et al.
5,993,602 A 11/1999 Smith et al.
6,010,598 A 1/2000 Boutilier et al.
6,033,525 A * 3/2000 Moffett ..... 162/175
6,096,169 A 8/2000 Hermans et al.
6,103,063 A 8/2000 Oriaran et al.
6,143,135 A 11/2000 Hada et al.
6,187,137 B1 2/2001 Druecke et al.
6,197,154 B1 3/2001 Chen et al.
6,201,093 B1 3/2001 Messner et al.
6,207,734 B1 3/2001 Vinson et al.
6,210,528 B1 4/2001 Wolkowicz
6,241,853 B1 6/2001 Smith et al.
6,264,791 B1 7/2001 Sun et al.
6,290,765 B1 * 9/2001 Jaycock et al. ..... 106/215.3
6,398,912 B1 6/2002 Vihervaara et al.
6,461,476 B1 10/2002 Goulet et al.
6,736,933 B2 * 5/2004 Jewell et al. ..... 162/9
2001/0014736 A1 8/2001 Likitalo et al.
2004/0062909 A1 * 4/2004 Tsapatsis et al. ..... 428/131
2004/0112559 A1 * 6/2004 Du Bourg et al. ..... 162/175

* cited by examiner

TISSUE WITH SEMI-SYNTHETIC CATIONIC POLYMER

BACKGROUND

In the art of tissue making and papermaking in general, many additives have been proposed for specific purposes, such as increasing wet strength, improving softness, or control of wetting properties. For example, cationic starch, natural starch, and synthetic polymers such as wet strength resins have been added to tissue and paper webs in general to modify dry strength, wet strength, water resistance, or other properties, or to improve certain manufacturing processes. In tissue making, such additives have also been used to improve the manufacturing process of creping. For example, cationic starch has been proposed as a creping aid to be applied in aqueous solution to the surface of a Yankee dryer prior to adhering an embryonic tissue web to the drum. Such a proposal is made by Vinson et al. in U.S. Pat. No. 6,207,734, "Creping Adhesive For Creping Tissue Paper," issued on Mar. 27, 2001, which discloses creping of tissue with a creping additive comprising cationic starch having between about 0.001 and about 0.2 cationic substituents per anhydroglucose unit of the cationic starch. However, it is known that in typical cationic starch, cationic groups (quarternary ammonium) are added to starch with a degree of substitution of about 2 to 5% (from about 0.02 to about 0.05 cationic substituents per anhydroglucose unit of the cationic starch), resulting in about 0.15% to about 0.5% nitrogen by weight added to the cationic starch. This degree of cationic substitution in the starch is an inherent limitation of conventional cationic starch, in which the degree of cationic substitution is typically constrained to be less than about 0.1 in practice because of processing difficulties when higher degrees of substitution are attempted. Starch and cationic starch also pose practical difficulties in their application to a paper web due to limited water solubility and high viscosity. Typical cationic starch is provided as granules and has a molecular weight of about 50 to 500 million.

The limitations in chemistry and physical properties of cationic starch translate into limitations in what may be achieved when cationic starch is used in creping or in other papermaking processes.

The processes and chemistry used in creping and other tissue making or paper making processes may play a significant role in product quality, cost, and runnability. Improvements in the chemistry used to adhere tissue web to the surface of a Yankee dryer, for example, may improve the balance between the need to firmly adhere the tissue web to the surface of the Yankee dryer and the need to release the tissue web from the surface of the Yankee dryer. If the adhesion is too strong, the tissue web can be damaged upon creping. If too weak, the proper degree of softness and bulk may not be obtained by the mechanical action of the creping blade, or the contact between the tissue web and the dryer may be inadequate to promote good drying, or the tissue web may separate prematurely and break. If the creping aid is not applied uniformly due to processing limitations (poor mixing or poor spray performance due to high viscosity, or plugging of spray nozzles due to particulates or poor solubility), then nonuniform creping may occur. If too much of the creping aid remains on the tissue web or of the creping aid forms too thick of a layer on the surface of the Yankee dryer, then the tissue may have undesirable deposits or coloration or odor.

Creping is not the only situation in which a balance between adhesion and release is needed for a tissue product in contact with a surface. There is a need for improved control of adhesion and release of tissue from surfaces on which no creping is involved, such as from through air dryer fabrics and other drying fabrics, impression fabrics, drum dryers, embossing rolls, calendering rolls, rush transfer zones, and other nips and surfaces.

SUMMARY OF THE INVENTION

It has been discovered that improved tissue products can be made, and improved tissue manufacturing processes can be achieved, through the use of semi-synthetic cationic polymers derived in part from a starch. However, these semi-synthetic cationic polymers contain much higher degrees of cationic substitution than previously attainable with cationic starch or other conventional forms of starch, and offering substantially higher water solubility or lower viscosity or both than previously attainable with cationic starch or other forms of starch. Such polymers are derived from polysaccharides that have been cleaved into relatively low molecular weight components and have been treated to have degrees of cationic substitution in excess of 0.1. Such polymers are exemplified by the series of Raifix® polymers from Raisio Chemicals (Helsinki, Finland). The Raifix® 120 polymer, for example, is believed to have over 70% cationic substitution. Such polymers may be made by first cleaving the starch with peroxide hydrolysis to yield low molecular weight units (e.g., 0.5 to 1.5 million Daltons), followed by processing to add cationic groups. A fully soluble product may be obtained (e.g., a 20% solids solution). The solids level of the semi-synthetic cationic polymer as provided for use in a tissue making process (prior to being mixed with other solutions to form a drum drying additive, for example) can be about 1% or greater, about 5% or greater, about 10% or greater, about 15% or greater, about 20% of greater, or about 30% or greater, with exemplary ranges of from about 5% to about 25%, or from about 10% to about 25%. The product may be highly branched due to the presence of amylopectin in the starting material (e.g., potato starch).

Unlike many synthetic cationic polymers, semi-synthetic cationic polymers have a hydrophilic backbone and are derived from an inherently hydrophilic polymer with many hydroxyl groups for hydrogen bonding. Unlike synthetic cationic polymers, semi-synthetic cationic polymers are derived from natural polymers, in particular from polysaccharides, such as starch and modified starch. Semi-synthetic cationic polymer can also have a molecular weight range greater than that of typical synthetic cationic polymers of use in tissuemaking (which often have a range of about 20,000 to about 800,000 Daltons) but lower than that of the natural polymers from which they are derived.

Raifix® polymers are marketed as fixing agents for turbidity control, and to control pitch and stickies in whitewater. Related but higher molecular weight polymers, Raibond® polymers, are marketed as strength and retention agents. Another related class of polymers, Raifob®, is a combination of a Raifix-like cationic polymer with added styrene acrylate groups to yield a soft sizing agent. But additional uses for such polymers and related semi-synthetic cationic polymers have now been discovered as a component in adhesion control additives for controlling the adhesion of tissue or other paper webs (including a moist embryonic tissue web) to dryer drums or other surfaces involved in the drying or texturing of a tissue web. As used herein, an "adhesion control additive" according to the present invention refers to any additive comprising a semi-synthetic cationic polymer used to modify the adhesion and/or release of a cellulosic web, particularly a paper or tissue web, from a surface used in the manufacturer of the web, and more particularly a surface used for drying, dewatering, or texturing of a the web.

A specific class of adhesion control additives is a drum drying additive. As used herein, a "drum drying additive" refers to a compound comprising a semi-synthetic cationic polymer for use in controlling the adhesion of a tissue web to a surface such as a drum dryer, including a Yankee dryer surface, or other surface used to dry or dewater a tissue web. A particular class of drum drying additive is a creping additive, used to control the adhesion and release of a tissue web from the surface of a Yankee dryer or similar heated drum from which the tissue web is creped. A creping additive is typically an aqueous solution that is sprayed or coated onto a dryer surface, such as a Yankee dryer drum, prior to application of a tissue web to the surface, after which the tissue web may be creped off the surface by the action of a creping blade. However, in some embodiments, the tissue web may be removed from a surface, such as a Yankee dryer or other heated drum, without creping, but by being peeled or pulled off by other mechanical means, such as those disclosed by Druecke et al. in U.S. Pat. No. 6,187,137, issued on Feb. 13, 2001, and by Chen et al. in U.S. Pat. No. 6,197,154, issued on Mar. 6, 2001, both of which are herein incorporated by reference to the extend that they are non-contradictory herewith.

The adhesion control additives of the present invention may also be used to control adhesion and release from other surfaces, such as a through-drying fabric or other drying fabrics, an imprinting fabric or impression fabric, a textured metal or polymeric drum, an embossing roll, a calender roll, other nips and web transfer zones, and the like. In one embodiment, the surface to which the web is contacted and removed is heated to a surface temperature of at least about 70° C., such as from about 95° C. to about 200° C., or from about 110° C. to about 160° C. A heated surface is typically used to promote drying, but can also be used to cure reactive chemicals in the tissue web, to provide texture to the tissue web, or to provide other properties.

The adhesion control additive may be sprayed, coated, or otherwise applied directly to the drying drum or other surface before contact with the tissue web, or may be sprayed, coated, printed, transferred by direct contact, or otherwise applied onto the tissue web before (e.g., less than about 2 seconds before, or less than about 0.2 seconds before) the tissue web contacts the surface. In drum drying, typically the side of the tissue web that will contact the drying drum, known as the drum side of the tissue web, is the side to which the adhesion control additive (a drum drying additive) should be applied when it is first applied to the tissue web. However, it is understood that the adhesion control additive may be applied to the opposing side of the tissue web for curative aspects.

The use of semi-synthetic cationic polymers in adhesion control additives, particularly as drum drying additives and most specifically particularly as creping aids, may provide a softer tissue web for a given degree of creping and for given tensile properties of the tissue web, than a similar process using more conventional chemistry. In particular, the lower molecular weight of Raifix® polymers and related semi-synthetic cationic polymers relative to starch, cationic starch, or conventional creping polymers such as polyvinyl alcohol or polyamide-epihalohydrin (particularly the molecular weight after the polyamide-epihalohydrin has formed a crosslinked film), permits a more flexible adhesive layer to form between the tissue web and the dryer surface, such as on a Yankee dryer. This adhesive layer formed by the semi-synthetic cationic polymer is capable of promoting excellence adhesion and creping, yet the portion of the semi-synthetic cationic polymer that transfers to the tissue web is substantially less stiff than conventional creping aids, allowing for a softer tissue product.

It is well known that a portion of an adhesion control additive such as a creping aid or any water-soluble additive disposed between a drum and a tissue web may transfer to the tissue web. A transfer may occur via any of several mechanisms, such as by absorption (e.g., wicking) when the adhesion control additive is still at least partially in a liquid form when contact with the tissue web is made, by physical adsorption, by diffusion, by mechanical splitting or fracture of the dried film of the adhesion control additive when the tissue web is creped or pulled off the drying surface, and the like. If the portion of the adhesive control additive that transfers to the tissue web tends to form a stiff film when dry, the softness of the tissue web may be adversely affected. On the other hand, if the portion of the adhesive control additive is too soft, then proper adhesion can be lost.

In one embodiment of the present invention, the distribution of the semi-synthetic cationic polymer in the tissue web is heterogeneous. For example, one side of the tissue web may comprise substantially more of the semi-synthetic cationic polymer than the other side of the tissue web. When the semi-synthetic cationic polymer is used as a drum drying additive on a surface, such as a Yankee dryer, with or without creping, the side of the tissue web that contacts the surface of the drum (the drum side, as opposed to the air side, of the tissue web) may be the only side of the tissue web comprising a substantial quantity of the drum drying additive. In other embodiments of the present invention, only one side of the tissue web has the adhesion control additive containing the semi-synthetic cationic polymer applied to it by spraying or other means.

In another embodiment, one layer of a multilayered tissue web formed with a layered headbox or other means comprises a higher proportion of the semi-synthetic cationic polymer or the adhesion control additive than other layers. For example, one layer of the web (e.g., an outer 50% of the web, or an inner 33% of the web, such as a 15 gsm layer in a 45 gsm web) can have more than about 0.01% by weight or more than about 0.1% by weight of the semi-synthetic cationic polymer, while another layer of similar thickness or basis weight has less than 50% as much semi-synthetic cationic polymer, including essentially no semi-synthetic cationic polymer.

In another embodiment, the semi-synthetic cationic polymer or the adhesion control additive is applied heterogeneously to the tissue web to form a pattern, such as a pattern of stripes, dots, or circles formed by printing or otherwise applying the semi-synthetic cationic polymer to the tissue web.

In one embodiment of the present invention, the tissue web has wet strength properties but is substantially free of chlorine-containing permanent wet strength agents such as epichlorohydrin products (e.g., Kymene wet strength agents of Hercules, Inc., Wilmington, Del.).

A semi-synthetic cationic polymer or an adhesion control additive comprising a semi-synthetic cationic polymer may be substantially biodegradable.

Cellulosic tissue webs prepared according to the present invention may be used not only for tissue products such as facial tissue, paper towels, bath tissue or other paper products, but in a wide variety of products as well, such as diapers, sanitary napkins, and other absorbent articles, wet wipes, towels, composite materials, molded paper products, paper cups and plates, and the like. Examples of composite materials include the laminated sponge substitutes of commonly owned application U.S. Ser. No. 10-036736, filed on Dec. 21, 2001, by Chen et al.

The Semi-synthetic Cationic Polymer

The adhesion control additives of the present invention comprise a semi-synthetic cationic polymer having a degree of cationic substitution of about 0.1 or greater and typically about 0.2 or greater, such as about 0.22 or greater, about 0.3 or greater, about 0.4 or greater, or about 0.5 or greater, with exemplary ranges of any of the following: from about 0.15 to about 0.99, from about 0.2 to about 0.85, from about 0.25 to about 0.75, or from about 0.4 to about 0.8. The cationic substituent is generally a quaternary amine, such as quaternary trimethyl ammonium. The quaternary amine group is generally able to retain its charge over a broad pH range. However, suitable cationic groups added to the polymer may include quaternary ammonium groups, as well as suitable amino groups (primary, secondary, tertiary, and aryl amines, for example, as well as immonium groups). Quaternary and tertiary amines, as well as other cationic groups, may be added by etherifying the initial polymer or its cleaved derivative to join the cationic group. A useful cationizing agent for adding a quaternary ammonium group via an ether bond to the hydroxyl groups on starch is 2,3-epoxypropyltrimethylammonium chloride or related salts. Related compounds with a chlorohydrin functional nature may also be used, as well as other known cationizing agents.

The added cationic group may also be selected from other known cationic groups such as phosphonium groups, sulfonium groups, or other onium compounds such as iodonium groups. The cationic groups may be derived from groups that are not initially cationic, such as isocyanates which can form amines or other cationic groups; polymers with such groups can become cationic during use. In one embodiment, the cationic group is derived from choline, as described in PCT publication, WO 01/90199, published on Nov. 29, 2001, or from betaine, as described in PCT publication, WO 00/15669, published on Mar. 30, 2000. In another embodiment, the semi-synthetic cationic polymer is substantially chlorine free or, in a related embodiment, is prepared without the use of chlorine, or without the release of hydrochloric acid, or without the generation of chlorinated compounds.

The semi-synthetic cationic polymers of use in the present invention typically have mean molecular weights of about 5,000,000 or less, such as from about 50,000 to about 3,000,000, specifically from about 100,000 to about 2,000,000, more specifically from about 200,000 to about 1,600,000, and most specifically from about 900,000 to about 1,600,000 or from 200,000 to about 950,000. Alternatively, the molecular weight of the semi-synthetic cationic polymer may be from about 850,000 to about 5,000,000, or from about 1,000,000 to about 4,000,000. The nitrogen content of the semi-synthetic cationic polymers by weight may be greater than about 0.5% or greater than about 1%, such as from about 0.5% to about 5%, specifically from about 1% to about 4%, more specifically from about 1% to about 3.5% (corresponding roughly to a degree of cationic substitution of from about 0.2 to about 0.7 in Raifix® polymers), more specifically still from about 1.5% to about 3.5%, and most specifically from about 2% to about 3.5%.

At 25° C., the viscosity of the semi-synthetic cationic polymer solution at about 5% solids by weight can be about 1.5 centipoise (cp) or higher, such as about 5 cp or higher, about 10 cp or higher, or about 20 cp or higher. When the molecular weight is sufficiently low, the viscosity may be about 200 cp or less, such as about 100 cp or less, more specifically about 50 cp or less, and most specifically about 20 cp or less. Exemplary ranges can include from about 2 cp to about 150 cp, or from about 4 cp to about 80 cp, or from about 3 cp to about 45 cp. At 25 C., the viscosity of the semi-synthetic cationic polymer solution at about 10% solids by weight may be about 3 centipoise (cp) or higher, such as about 10 cp or higher, about 15 cp or higher, or about 25 cp or higher. When the molecular weight is sufficiently low, the viscosity may be about 200 cp or less, such as about 120 cp or less, more specifically about 60 cp or less, and most specifically about 25 cp or less. Exemplary ranges can include from about 5 cp to about 150 cp, or from about 6 cp to about 85 cp, or from about 5 cp to 45 cp.

Methods of producing certain semi-synthetic cationic polymers are disclosed in PCT publication, WO 95/18157, published on Jul. 6, 1995, the U.S. counterpart of which is herein incorporated by reference to the extent that it is non-contradictory herewith. Related methods for adding cationic groups to polysaccharides such as starch or starch derivatives are disclosed in PCT publication, WO 99/62957, published on Dec. 9, 1999, the U.S. counterpart (published application U.S. 20010014736) of which is herein incorporated by reference to the extent that it is non-contradictory herewith. A related disclosure of methods for adding cationic groups to reduced molecular weight starch is given in U.S. Pat. No. 6,398,912, issued on Apr. 6, 2002 to Vihervaara et al., herein incorporated by reference to the extend that it is non-contradictory herewith.

The semi-synthetic cationic polymer when combined with the tissue web or with cellulosic fibers may have any pH, though in many embodiments of the present invention, it is desired that the semi-synthetic cationic polymer solution in contact with the tissue web or with cellulosic fibers have a pH of or below any of about 10, about 9, about 8 and about 7, such as from about 2 to about 8, specifically from about 2 to about 7, more specifically from about 3 to about 6, and most specifically from about 3 to about 5.5. Alternatively, the pH range may be from about 5 to about 9, specifically from about 5.5 to about 8.5, and most specifically from about 6 to about 8. These pH values may apply to the semi-synthetic cationic polymer prior to contacting the tissue web or cellulosic fibers, or to a mixture of semi-synthetic cationic polymer and a second compound in contact with the tissue web or the cellulosic fibers prior to drying.

The semi-synthetic cationic polymer may be provided as a water-soluble solution that does not require heating or "make down" operations in which the semi-synthetic cationic polymer is provided as a solid requiring cooking to solubilize. The semi-synthetic cationic polymer may be sufficiently soluble that at 25° C., an aqueous solution substantially free of undissolved semi-synthetic cationic polymer may comprise about 10% by weight of the semi-synthetic cationic polymer or greater, such as about 15% by weight or greater or about 19% by weight or greater or about 20% by weight or greater. These solubilities may be maintained over a range of pH values, such as from about 3 to about 10, more specifically from about 6 to about 10, more specifically still from about 7 to about 9.

Composition of the Adhesion Control Additives

The adhesion control additive typically is a solution (e.g., an aqueous solution) having at least about 0.05% solids by weight (all percentages are weight percentages unless otherwise specified), specifically at least about 0. 1% solids, more specifically at least about 0.5% solids, and most specifically at least about 1% solids. Without limitation, ranges of solids content can be any of the following: from about 0.1% to about 0.6%, from about 0.2% to about 5%, from about 0.3% to about 3%, from about 0.5% to about 2%, and from about 0.5% to about 1.7%. In some applications, the high water solubility of many of the semi-synthetic cationic polymers permits solutions having much higher solids content to be applied, with solids of or higher than about 5%, about 10%, or about 15%, with exemplary ranges such as from about 1% to about 25%, from about 2% to about 20%, from about 3% to about 15%, and from about 5% to about 10%.

The solids faction of the adhesion control additive may be essentially 100% semi-synthetic cationic polymers, or may comprise a mixture of semi-synthetic cationic polymers with other polymers (including synthetic, semi-synthetic, and natural polymers) and/or with other chemicals such as electrolytes, acids, bases, colorants, debonders, emollients, silicone compounds, and the like. For example, semi-synthetic cationic polymers of the present invention may be combined with any known creping aids such as polyvinyl alcohol, PAE resins, Kymene, cationic starch, polyvinylamines, and the like.

To increase the ease with which tissue web is released from a surface, hydrophobic components may be present such as the styrene acrylate of the Raifob® polymers available Raisio Chemicals (Helsinki, Finland), as well as other known debonders such Resozol 2008 and Resozol available from Hercules, Inc. (Wilmington, Del.), as well as quaternary ammonium compounds with alkyl or lipid side chains, softening compounds, emollients, silicones, lotions, waxes, and oils. Further discussions of debonders is found herein below.

The solids fraction may comprise at least about 1% of semi-synthetic cationic polymer, more specifically at least about 5%, more specifically still at least about 10%, and most specifically at least about 20% by weight. Exemplary ranges for the weight percent semi-synthetic cationic polymer in the solids faction of the adhesion control additives may include any of the following: from about 5% to about 98%, from about 10% to about 80%, from about 15% to about 75%, from about 50% to about 100%, from about 1% to about 50%, from about 10% to about 40%, from about 30% to about 99%, and the like. The total amount of semi-synthetic cationic polymer in the adhesion control additive in solution form, relative to the total weight of the solution, may be at least about 0.05% or any of the values previously given for the weight percent of solids in the adhesion control additives (e.g., at least about 1%, from about 0.1% to about 0.6%, from about 0.2% to about 5%, etc.).

The application level of the adhesion control additive or the semi-synthetic cationic polymer per se may be from about 0.01% to about 25% relative to the dry mass of the tissue web. More specifically, the application level can be from about 0.5% to about 4%, or from about 0.1% to about 2%. Higher and lower application levels are also within the scope of the present invention. In some embodiments, for example, application levels of from about 5% to about 50% or higher can be considered.

Other common components in adhesion control additives may include polyamide-epihalohydrins, though in some embodiments of the present invention, the adhesion control additive is substantially free of polyamide-epihalohydrin and/or substantially free of chlorinated compounds, particularly chlorinated polymers. Polyols such as polyvinyl alcohol can also be formulated in the adhesion control additives of the present invention. Acrylic resins, latexes, and other adhesion promoting agents known in the art may be used. Release agents such as waxes, quaternary ammonium compounds with alkyl chains, commercial debonders, including Resozol 2008 and Resozol 1095 compounds, and silicone compounds (including those disclosed in U.S. Pat. No. 6,187,137, issued on Feb. 13, 2001 to Druecke et al.), can comprise a portion of the adhesion control additives. For example, the solids of an aqueous solution/suspension of an adhesion control additives may comprise from about 0 to about 50% of a polyol or sugar (e.g., sorbitol, sucrose, and the like), from about 1% to about 80% of a semi-synthetic cationic polymer, from about 0 to about 50% of a polyamide or polyamide derivative including polyamide-epihalohydrin, and from about 0 to about 30% of a debonder. Without limitation, exemplary formulations can comprise or essentially consist of any of the following mixtures, though many other combinations not within the scope of the following examples may also be within the scope of the present invention:

From about 5% to about 30% semi-synthetic cationic polymer; from about 1% to about 10% debonder; from about 20% to about 70% of a polyol or sugar; and, substantially no polyamides or halogenated compounds.

From about 20% to about 90% semi-synthetic cationic polymer; from about 1% to about 10% debonder; from about 0% to about 40% of a polyol or sugar; and, substantially no polyamides or halogenated compounds.

From about 20% to about 90% semi-synthetic cationic polymer; from about 1% to about 10% debonder; from about 5% to about 30% of a wet strength resin such as an epichlorohydrin product; and, from about 0% to about 40% of a polyol or sugar.

From about 10% to about 80% of a polyol or sugar; and, from about 20% to about 90% of a semi-synthetic cationic polymer.

DETAILED DESCRIPTION OF THE INVENTION

Figure 1:
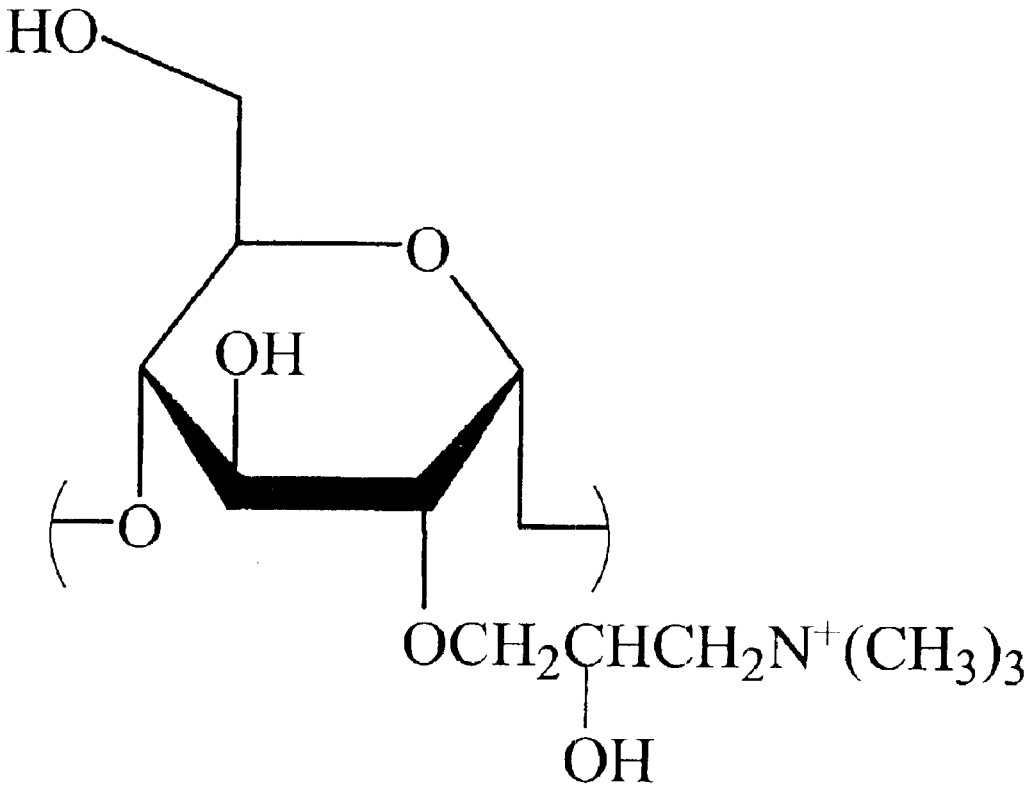
FIG. 1 is a depiction of a typical unit in the Raifix® polymers.

The semi-synthetic cationic polymers of use in the present invention may be incorporated in a tissue web as aqueous solutions by addition to a dry or moist cellulosic tissue web. Alternatively or in addition, the semi-synthetic cationic polymer may be incorporated into an adhesion control additive that is applied to modify the adhesion of a cellulosic tissue web to a surface such as a heated drum (e.g., a Yankee dryer), or to other surfaces, particularly heated surfaces, that will contact the cellulosic tissue web. Other compounds such as polymeric anionic reactive compounds may be combined with the semi-synthetic cationic polymer in any of these forms, and these other compounds can be in the form of a solution, suspension, or slurry.

Application of either the semi-synthetic cationic polymer or a second compound may be achieved by any of the following:

Adhesion to the tissue web of the compound in the form of a drum drying additive present between the tissue web and a dryer drum surface, wherein a portion of the compound remains with the tissue web when the tissue web is separated from the dryer drum by creping, peeling, pulling, action of an air knife, or any other means known in the art.

Direct addition to a fibrous slurry, such as by injection of the compound into a slurry prior to entry in the headbox. Slurry consistency can be from about 0.2% to about 50%, specifically from about 0.2% to about 10%, more specifically from about 0.3% to about 5%, and most specifically from about 1% to about 4%.

A spray applied to fibrous tissue web. For example, spray nozzles may be mounted over a moving tissue web to apply a desired dose of a solution to the tissue web that may be moist or substantially dry. Nebulizers may also be used to apply a light mist to a surface of a tissue web.

Printing onto a tissue web, such as by offset printing, gravure printing, flexographic printing, ink jet printing, digital printing of any kind, and the like.

Coating onto one or both surfaces of a tissue web, such as blade coating, air knife coating, short dwell coating, cast coating, and the like.

Extrusion from a die head of the compound in the form of a solution, a dispersion, or emulsion, or a viscous mixture comprising the compound and a wax, softener, debonder, oil, polysiloxane compound or other silicone agent, an emollient, a lotion, an ink, or other additive, as disclosed, for example, in PCT publication, WO 2001/12414, published on Feb. 22, 2001, the U.S. equivalent of which, U.S. patent application Ser. No. 09/377,661 filed on Aug. 19, 1999, is herein incorporated by reference to the extent that it is non-contradictory herewith.

Application to individualized fibers. For example, comminuted or flash dried fibers may be entrained in an air stream combined with an aerosol or spray of the compound to treat individual fibers prior to incorporation into a tissue web or other fibrous product.

Impregnation of a wet or dry tissue web with a solution or slurry, wherein the compound penetrates a significant distance into the thickness of the tissue web, such as at least about 20% of the thickness of the tissue web, more specifically at least about 30% and most specifically at least about 70% of the thickness of the tissue web, including completely penetrating the tissue web throughout the full extent of its thickness. One useful method for impregnation of a moist tissue web is the Hydra-Sizer® system, produced by Black Clawson Corp., Watertown, N.Y., as described in "New Technology to Apply Starch and Other Additives," *Pulp and Paper Canada*, 100(2): T42–T44 (February 1999). This system consists of a die, an adjustable support structure, a catch pan, and an additive supply system. A thin curtain of descending liquid or slurry is created which contacts the moving tissue web beneath it. Wide ranges of applied doses of the coating material are said to be achievable with good runnability. The system can also be applied to curtain coat a relatively dry tissue web, such as a tissue web just before or after creping.

Foam application of the compound to a fibrous tissue web (e.g., foam finishing), either for topical application or for impregnation of the compound into the tissue web under the influence of a pressure differential (e.g., vacuum-assisted impregnation of the foam). Principles of foam application of additives such as binder agents are described in U.S. Pat. No. 4,297,860, "Device for Applying Foam to Textiles," issued on Nov. 3, 1981 to Pacifici et al.; and, U.S. Pat. No. 4,773,110, "Foam Finishing Apparatus and Method," issued on Sep. 27, 1988 to G. J. Hopkins, both of which are herein incorporated by reference to the extent that they are non-contradictory herewith.

Padding of a solution of the compound into an existing fibrous tissue web.

Roller fluid feeding of the compound for application to the tissue web.

Application of the compound by spray or other means to a moving belt or fabric which in turn contacts the tissue web to apply the chemical to the tissue web, such as is disclosed in PCT publication, WO 01/49937 by S. Eichhorn, "A Method of Applying Treatment Chemicals to a Fiber-Based Planar Product Via a Revolving Belt and Planar Products Made Using Said Method," published on Jun. 12, 2001.

Topical application of the semi-synthetic cationic polymer to an embryonic tissue web may occur prior to drum drying or through drying, and optionally after final vacuum dewatering has been applied.

Before the semi-synthetic cationic polymer and/or second compound is applied to an existing tissue web, such as a moist embryonic tissue web, the solids level of the tissue web may be about 10% or higher (i.e., the tissue web comprises about 10 grams of dry solids and 90 grams of water, such as about any of the following solids levels or higher: 12%, 15%, 18%, 20%, 25%, 30%, 35%, 40%, 45%, 50%, 60%, 75%, 80%, 90%, 95%, 98%, and 99%, with exemplary ranges of from about 30% to about 100% and more specifically from about 65% to about 90%). The solids level of the tissue web immediately after application of any of the semi-synthetic cationic polymer, a second compound, or a mixture thereof may also be any of the previously mentioned solids levels.

The adhesion control additives can be applied to or during the manufacture of tissue webs that are pattern densified or imprinted, such as the tissue webs disclosed in any of the following U.S. Pat. No. : 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on Aug. 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Steliljes, Jr. et al.; U.S. Pat. No. 5,500,277, issued on Mar. 19, 1996 to Trokhan et al.; U.S. Pat. No. 5,514,523, issued on May 7, 1996 to Trokhan et al.; U.S. Pat. No. 5,554,467, issued on Sept. 10, 1996, to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; and, U.S. Pat. No. 5,628,876, issued on May 13, 1997 to Ayers et al., the disclosures of which are incorporated herein by reference to the extent that they are non-contradictory herewith. Such imprinted tissue webs can have a network of densified regions that have been imprinted against a drum dryer by an imprinting fabric, and regions that are relatively less densified (e.g., "domes" in the tissue web) corresponding to deflection conduits in the imprinting fabric, wherein the tissue web superposed over the deflection conduits was deflected by an air pressure differential across the deflection conduit to form a lower-density pillow-like region or dome in the tissue web.

In such tissue webs, the adhesion control additives or other chemicals may be selectively concentrated in the densified regions of the tissue web (e.g., a densified network corresponding to regions of the tissue web compressed by an imprinting fabric pressing the tissue web against a Yankee dryer, wherein the densified network can provide good tensile strength to the three-dimensional tissue web). This may be due to the more intimate contact of the tissue web to a drum drying additive in regions where the tissue web is pressed most intensely against the drum dryer surface.

A heterogeneous distribution of drum drying additive in the tissue web selectively concentrated at the most densified regions (e.g., regions corresponding to fabric knuckles that pressed the tissue web against the drum dryer) may also be due to migration of liquid solution between the fibers driven by capillary forces when a portion of the tissue web is dried, with higher drying rates in the densified regions resulting in more evaporation and more wicking transport of liquid and dissolved chemicals to the regions with the higher drying rate. The principle of chemical migration at a microscopic level during drying is well attested in the literature. See, for example, A. C. Dreshfield, "The Drying of Paper," *Tappi Journal*, Vol. 39, No. 7, 1956, pages 449–455; A. A. Robertson, "The Physical Properties of Wet Webs. Part I," *Tappi Joumal*, Vol. 42, No. 12, 1959, pages 969–978; U.S. Pat. No. 5,336,373, "Method for Making a Strong, Bulky, Absorbent Paper Sheet Using Restrained Can Drying," issued on Aug. 9, 1994 to Scattolino et al., herein incorporated by reference to the extent that it is non-contradictory herewith; and, U.S. Pat. No. 6,210,528, "Process of Making Web-Creped Imprinted Paper," issued on Apr. 3, 2001 to Wolkowicz, herein incorporated by reference to the extent that it is non-contradictory herewith. Without wishing to be bound by theory, it is believed that significant chemical migration may occur during drying when the initial solids content (dryness level) of the tissue web is at or below about 60% (specifically, at or below about any of 65%, 63%, 60%, 55%, 50%, 45%, 40%, 35%, 30%, and 27%, such as from about 30% to about 60%, or from about 40% to about 60%). The degree of chemical migration will depend on the surface chemistry of the fibers and the chemicals involved, the details of drying, the structure of the tissue web, and so forth. On the other hand, if the tissue web having a solid contents at or about 60% is through-dried to a high dryness level, such as at least any of about 60% solids, about 70% solids, and about 80% solids (e.g., from about 65% solids to about 99% solids, or from about 70% solids to about 87% solids), then regions of the tissue web disposed above the deflection conduits (i.e., the bulky "domes" of the pattern-densified tissue web) may have a higher concentration of semi-synthetic cationic polymer or other water-soluble chemicals than the densified regions, for drying will tend to occur first in the regions of the tissue web through which air can readily pass, and capillary wicking can bring fluid from adjacent portions of the tissue web to the regions where drying is occurring most rapidly. In short, depending on how drying is carried out, water-soluble reagents may be present at a relatively higher concentration compared to other portions of the web in the densified regions or the less densified regions ("domes").

The reagents of the adhesion control additive may also be present substantially uniformly in the tissue web, or at least without a selective concentration in either the densified or undensified regions.

Other Strength Additives

As used herein, "wet strength agents" are materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it may be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph, and other body exudates.

Any material that when added to a paper or tissue web or sheet results in providing the sheet with a mean wet geometric tensile strength:dry geometric tensile strength ratio in excess of 0.1 will, for purposes of the present invention, be termed a wet strength agent. Typically these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50% of its original wet strength after exposure to water for a period of at least five minutes. Temporary wet strength agents are those which show less than 50% of their original wet strength after being saturated with water for five minutes. Both classes of material find application in the present invention. The amount of wet strength agent added to the pulp fibers may be at least about 0.1 dry weight percent, more specifically about 0.2 dry weight percent or greater, and still more specifically from about 0.1 to about 3 dry weight percent, based on the dry weight of the fibers.

Permanent wet strength agents will provide a more or less long-term wet resilience to the web structure. In contrast, the temporary wet strength agents would provide web structures that had low density and high resilience, but would not provide a structure that had long-term resistance to exposure to water or body fluids.

The wet strength additives may be cationic, nonionic or anionic. Such compounds include PAREZ™ 631 NC wet strength resin, a cationic glyoxylated polyacrylamide available from Cytec Industries (West Paterson, N.J.). This and similar resins are described in U.S. Pat. No. 3,556,932 issued on Jan. 19, 1971 to Coscia et al. and U.S. Pat. No. 3,556,933 issued on Jan. 19, 1971 to Williams et al. Hercobond 1366, manufactured by Hercules, Inc. (Wilmington, Del.) is another commercially available cationic glyoxylated polyacrylamide that may be used according to the present invention. In one embodiment, the additives are not strongly cationic to decrease repulsive forces in the presence of the semi-synthetic cationic polymer.

Permanent wet strength agents comprising cationic oligomeric or polymeric resins may be used in the present invention, but do not generally yield the synergy observed with less cationic additives. Polyamide-polyamine-epichlorohydrin type resins such as KYMENE 557H sold by Hercules, Inc. (Wilmington, Del.) are the most widely used permanent wet-strength agents, but have come under increasing environmental scrutiny due to the reactive halogen group in these molecules. Such materials have been described in patents issued to Keim (U.S. Pat. Nos. 3,700,623 and 3,772,076); Petrovich (U.S. Pat. Nos. 3,885,158; 3,899,388; 4,129,528; and, 4,147,586); and, van Eenam (U.S. Pat. No. 4,222,921). Other cationic resins include polyethylenimine resins and aminoplast resins obtained by reaction of formaldehyde with melamine or urea.

The efficacy of cationic wet strength agents may be enhanced by treatment of cellulosic fibers with reactive anionic compounds, according to U.S. Pat. No. 5,935,383, "Method for Improved Wet Strength Paper," issued on Aug. 10, 1999 to Sun and Lindsay, herein incorporated by reference to the extent that it is non-contradictory herewith.

Preparation of Webs

The cellulosic web to be treated can be made by any method known in the art. The tissue web can be wetlaid, such as tissue web formed with known tissuemaking techniques wherein a dilute aqueous fiber slurry is disposed on a moving wire to filter out the fibers and form an embryonic tissue web which is subsequently dewatered by combinations of units including suction boxes, wet presses, dryer units, and the like. Examples of known dewatering and other operations are given in U.S. Pat. No. 5,656,132, issued on Aug. 12, 1997 to Farrington et al. Capillary dewatering can also be applied to remove water from the web, as disclosed in U.S. Pat. No. 5,598,643, issued on Feb. 4, 1997, and U.S. Pat. No. 4,556,450, issued on Dec. 3, 1985, both to S. C. Chuang et al.

Drying operations may include drum drying, through drying, steam drying such as superheated steam drying, displacement dewatering, Yankee drying, infrared drying, microwave drying, radiofrequency drying in general, and impulse drying, as disclosed in U.S. Pat. No. 5,353,521, issued on Oct. 11, 1994 to Orloff; and, U.S. Pat. No. 5,598,642, issued on Feb. 4, 1997 to Orloff et al. Other drying technologies may be used, such as methods employing differential gas pressure include the use of air presses as disclosed in U.S. Pat. No. 6,096,169, "Method for Making Low-Density Tissue with Reduced Energy Input," issued on Aug. 1, 2000 to Hermans et al.; and, U.S. Pat. No. 6,143,135, "Air Press For Dewatering A Wet Web," issued on Nov. 7, 2000 to Hada et al., all of which are herein incorporated by reference to the extent that they are non-contradictory herewith. Also relevant are the paper machines disclosed in U.S. Pat. No. 5,230,776, issued on Jul. 27, 1993 to I. A. Andersson et al.

For tissue webs, both creped and uncreped methods of manufacture may be used. Uncreped tissue production is disclosed in U.S. Pat. No. 5,772,845, issued on Jun. 30, 1996 to Farrington, Jr. et al., herein incorporated by reference to the extent that it is non-contradictory herewith. Creped tissue production is disclosed in U.S. Pat. No. 5,637,194, issued on Jun. 10, 1997 to Ampulski et al.; U.S. Pat. No. 4,529,480, issued on Jul. 16, 1985 to Trokhan; U.S. Pat. No. 6,103,063, issued on Aug. 15, 2000 to Oriaran et al.; and, U.S. Pat. No. 4,440,597, issued on Apr. 3, 1984 to Wells et al., all of which are herein incorporated by reference to the extent that they are non-contradictory herewith.

For either creped or uncreped methods, embryonic tissue webs may be imprinted against a deflection member prior to complete drying. Deflection members have deflection conduits between raised elements, and the tissue web is deflected into the deflection member by an air pressure differential to create bulky domes, while the portions of the tissue web residing on the surface of the raised elements can be pressed against the dryer surface to create a network of pattern densified areas offering strength. Deflection members and fabrics of use in imprinting a tissue web, as well as related methods of tissue manufacture, are disclosed in the following: in U.S. Pat. No. 5,855,739, issued on Jan. 5, 1999 to Ampulski et al.; U.S. Pat. No. 5,897,745, issued on Apr. 27, 1999 to Ampulski et al.; U.S. Pat. No. 4,529,480, issued on Jul. 16, 1985 to Trokhan; U.S. Pat. No. 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992 to Smurkoski; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on August 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Stelljes, Jr. et al.; U.S. Pat. No. 5,500,277, issued on Mar. 19, 1996 to Trokhan et al.; U.S. Pat. No. 5,514,523, issued May 7, 1996 to Trokhan et al.; U.S. Pat. No. 5,554,467, issued on Sep. 10, 1996 to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; U.S. Pat. No. 6,010,598, issued on Jan. 4, 2000 to Boutilier et al.; and, U.S. Pat. No. 5,628,876, issued on May 13, 1997 to Ayers et al., as well as commonly owned application Ser. No. 09/705684 by Lindsay et al., all of which are herein incorporated by reference to the extent that they are non-contradictory herewith.

In addition, the cellulosic tissue web may be an airlaid web, such as those made with DanWeb or Kroyer equipment.

The fibrous tissue web is generally a random plurality of papermaking fibers that can, optionally, be joined together with a binder. Any papermaking fibers, as previously defined, or mixtures thereof may be used, such as bleached fibers from a kraft or sulfite chemical pulping process. Recycled fibers can also be used, as can cotton linters or papermaking fibers comprising cotton. Both high-yield and low-yield fibers can be used. In one embodiment, the fibers may be predominantly hardwood, such as at least 50% hardwood or about 60% hardwood or great or about 80% hardwood or greater or substantially 100% hardwood. In another embodiment, the tissue web is predominantly softwood, such as at least about 50% softwood or at least about 80% softwood, or about 100% softwood.

For many tissue applications, high brightness may be desired. Thus the papermaking fibers or the resulting tissue web of the present invention can have an ISO brightness of about 60 percent or greater, more specifically about 80 percent or greater, more specifically about 85 percent or greater, more specifically from about 75 percent to about 90 percent, more specifically from about 80 percent to about 90 percent, and more specifically still from about 83 percent to about 88 percent.

The fibrous tissue web of the present invention may be formed from a single layer or multiple layers. Both strength and softness are often achieved through layered tissue webs, such as those produced from stratified headboxes wherein at least one layer delivered by the headbox comprises softwood fibers while another layer comprises hardwood or other fiber types. Layered structures produced by any means known in the art are within the scope of the present invention, including those disclosed by Edwards et al. in U.S. Pat. No. 5,494,554. In the case of multiple layers, the layers are generally positioned in a juxtaposed or surface-to-surface relationship and all or a portion of the layers may be bound to adjacent layers. The tissue web may also be formed from a plurality of separate tissue webs wherein the separate tissue webs may be formed from single or multiple layers.

Dry airlaid tissue webs can also be treated with semi-synthetic cationic polymers. Airlaid tissue webs can be formed by any method known in the art, and generally comprise entraining fiberized or comminuted cellulosic fibers in an air stream and depositing the fibers to form a mat. The mat may then be calendered or compressed, before or after chemical treatment using known techniques, including those of U.S. Pat. No. 5,948,507 issued on Sep. 7, 1999 to Chen et al., herein incorporated by reference to the extent that it is non-contradictory herewith.

Whether airlaid, wetlaid, or formed by other means, the tissue web may be substantially free of latex and substantially free of film-forming compounds. The applied solution or slurry comprising semi-synthetic cationic polymer and/or a second compound may also be free of formaldehyde or cross-linking agents that evolve formaldehyde.

Other Embodiments

The semi-synthetic cationic polymer may be used in conjunction with any known materials and chemicals that are not antagonistic to its intended use. For example, when used in the production of fibrous materials in absorbent articles or other products, odor control agents may be present, such as odor absorbents, activated carbon fibers and particles, baby powder, baking soda, chelating agents, zeolites, perfumes or other odor-masking agents, cyclodextrin compounds, oxidizers, and the like. Superabsorbent particles, fibers, or films may also be employed. For example, an absorbent fibrous mat of comminuted fibers or an airlaid web treated with a semi-synthetic cationic polymer may be combined with superabsorbent particles to serve as an absorbent core or intake layer in a disposable absorbent article such as a diaper. A wide variety of other compounds known in the art of papermaking and tissue production can be included in the tissue webs of the present invention.

Fibers treated with a semi-synthetic cationic polymer can further be treated with known finishing agents such as amino-functional polysiloxanes, including those disclosed in U.S. Pat. No. 6,201,093, issued on Mar. 13, 2001 to Messner and Rautschek, herein incorporated by reference to the extent that it is non-contradictory herewith. Finishing treatments can be especially desirable when treated cellulosic fibers are combined with other fibers to provide a woven or nonwoven textile web, before or after dying or without dying. Such finishing agents can also be used for predominantly cellulosic tissue webs to impart improved tactile properties or wetting properties.

Debonders, such as quaternary ammonium compounds with alkyl or lipid side chains, may be used to provide high wet:dry tensile strength ratios by lowering the dry strength without a correspondingly large decrease in the wet strength. Softening compounds, emollients, silicones, lotions, waxes, and oils can also have similar benefits in reducing dry strength, while providing improved tactile properties such as a soft, lubricious feel. Fillers, fluorescent whitening agents, antimicrobials, ion-exchange compounds, odor-absorbers, dyes, and the like may also be added.

When debonders are to be applied, any debonding agent (or softener) known in the art may be utilized. The debonders may include silicone compounds, mineral oil and other oils or lubricants, quaternary ammonium compounds with alkyl side chains, or the like known in the art. Exemplary debonding agents for use herein are cationic materials such as quaternary ammonium compounds, imidazolinium compounds, and other such compounds with aliphatic, saturated or unsaturated carbon chains. The carbon chains may be unsubstituted or one or more of the chains may be substituted, e.g. with hydroxyl groups. Non-limiting examples of quaternary ammonium debonding agents useful herein include hexamethonium bromide, tetraethylammonium bromide, lauryl trimethylammonium chloride, and dihydrogenated tallow dimethylammonium methyl sulfate.

The suitable debonders may include any number of quaternary ammonium compounds and other softeners known in the art, including but not limited to, oleylimidazolinium debonders such as C-6001 manufactured by Goldschmidt AG (Essen, Germany) or Prosoft TQ-1003 from Hercules (Wilmington, Del.); Berocell 596 and 584 (quaternary ammonium compounds) manufactured by Eka Nobel Inc., which are believed to be made in accordance with U.S. Pat. Nos. 3,972,855 and 4,144,122; Adogen 442 (dimethyl dihydrogenated tallow ammonium chloride) manufactured by Crompton; Quasoft 203 (quaternary ammonium salt) manufactured by Quaker Chemical Company; Arquad 2HT75 (dihydrogenated tallow) dimethyl ammonium chloride) manufactured by Akzo Chemical Company; mixtures thereof; and, the like.

Other debonders can be tertiary amines and derivatives thereof; amine oxides; saturated and unsaturated fatty acids and fatty acid salts; alkenyl succinic anhydrides; alkenyl succinic acids and corresponding alkenyl succinate salts; sorbitan mono-, di- and tri-esters, including but not limited to stearate, palmitate, oleate, myristate, and behenate sorbitan esters; and particulate debonders such as clay and silicate fillers. Useful debonding agents are described in, for example, U.S. Pat. Nos. 3,395,708, 3,554,862, and 3,554,863 issued to Hervey et al.; U.S. Pat. No. 3,775,220 issued to Freimark et al.; U.S. Pat. No. 3,844,880 issued to Meisel et al.; U.S. Pat. No. 3,916,058 issued to Vossos et al.; U.S. Pat. No. 4,028,172 issued to Mazzarella et al.; U.S. Pat. No. 4,069,159 issued to Hayek; U.S. Pat. No. 4,144,122 issued to Emanuelsson et al.; U.S. Pat. No. 4,158,594 issued to Becker et al.; U.S. Pat. No. 4,255,294 issued to Rudy et al.; U.S. Pat. No. 4,314,001 issued to Wesseler; U.S. Pat. No. 4,377,543 issued to Strohbeen et al.; U.S. Pat. No. 4,432,833 issued to Breese et al.; U.S. Pat. No. 4,776,965 issued to Nuesslein et al.; and, U.S. Pat. No. 4,795,530 issued to Soerens et al.

The debonding agent can be added at a level of at least about 0.1%, specifically at least about 0.2%, more specifically at least about 0.3%, on a dry fiber basis. Typically, the debonding agent will be added at a level of from about 0.1 to about 6%, more typically from about 0.2 to about 3%, active matter on dry fiber basis. The percentages given for the amount of debonding agent are given as an amount added to the fibers, not as an amount actually retained by the fibers.

Softening agents known in the art of tissue making may also serve as debonders or hydrophobic matter suitable for the present invention and may include but not limited to: fatty acids; waxes; quaternary ammonium salts; dimethyl dihydrogenated tallow ammonium chloride; quaternary ammonium methyl sulfate; carboxylated polyethylene; cocamide diethanol amine; coco betaine; sodium lauroyl sarcosinate; partly ethoxylated quaternary ammonium salt; distearyl dimethyl ammonium chloride; methyl-1-oleyl amidoethyl-2-oleyl imidazolinium methylsulfate (Varisoft 3690 from Witco Corporation, now Crompton in Middlebury, Conn.); mixtures thereof; and, the like known in the art.

Principles for the use of debonders in tissue webs have been disclosed in the commonly owned, copending application, U.S. patent application Ser. No. 09/863612, "Uncreped Tissue Sheets Having a High Wet:Dry Tensile Strength Ratio," filed on May 23, 2001 by M. T. Goulet and H. D. Van Wychen, herein incorporated by reference to the extent that it is non-contradictory herewith.

Hydrophobic matter added to selected regions of the tissue web, especially the uppermost portions of a textured tissue web, may be valuable in providing improved dry feel in articles intended for absorbency and removal of liquids next to the skin. The above additives may be added before, during, or after the application of a second compound (e.g., a polymeric reactive anionic compound) and /or a drying or curing step. Webs treated with cationic polymers may be further treated with waxes and emollients, typically by a topical application. Hydrophobic material can also be applied over portions of the web. For example, it can be applied topically in a pattern to a surface of the web, as described in U.S. Pat. No. 5,990,377, "Dual-Zoned Absorbent Webs," issued on Nov. 23, 1999, herein incorporated by reference to the extent that it is non-contradictory herewith.

Surfactants may also be used, being mixed with either the semi-synthetic cationic polymer, a second compound, or added separately to the web or fibers. The surfactants may be anionic, cationic, or non-ionic, including but not limited to: tallow trimethylammonium chloride; silicone amides; silicone amido quaternary amines; silicone imidazoline quaternary amines; alkyl polyethoxylates; polyethoxylated alkylphenols; fatty acid ethanol amides; dimethicone copolyol esters; dimethiconol esters; dimethicone copolyols; mixtures thereof; and, the like known in the art.

Charge-modifying agents other than semi-synthetic cationic polymers may be used. Commercially available charge-modifying agents include Cypro 514, produced by Cytec, Inc. of Stamford, Conn.; Bufloc 5031 and Bufloc 534, both products of Buckman Laboratories, Inc. of Memphis, Tenn. The charge-modifying agent can comprise low-molecular-weight, high charge density polymers such as polydiallyldimethylammonium chloride (DADMAC) having molecular weights of about 90,000 to about 300,000, polyamines having molecular weights of about 50,000 to about 300,000 (including PVAm polymers) and polyethyleneimine having molecular weights of about 40,000 to about 750,000. After the charge-modifying agent has been in contact with the furnish for a time sufficient to reduce the charge on the furnish, a debonder may be added.

The semi-synthetic cationic polymers of the present invention may also be added to the pulp slurry or other parts of the tissuemaking process, such that it is present in the tissue web before drying or before contact with surfaces from which the tissue web is to be adhered and released. For example, a semi-synthetic cationic polymer may be added to a tissue web as a retention agent, and the same semi-synthetic cationic polymer or another semi-synthetic cationic polymer may further be added to a drying drum as a drum drying additive later in the manufacturing process.

Other Product Forms

The entire tissue web, or one or more surfaces thereof, or selectively the elevated regions or depressed regions of the tissue web when it is textured, may be provided with absorbency aids, as disclosed in U.S. Pat. No. 5,840,403, "Multi-Elevational Tissue Paper Containing Selectively Disposed Chemical Papermaking Additive," issued on Nov. 24, 1998 to Trokhan et al., herein incorporated by reference to the extent that it is non-contradictory herewith.

The tissue webs of the present invention may be used in many forms, including multilayered structures, composite assemblies, and the like. The tissue web may also be used as a basesheet for the construction of wet wipes, paper towels, and other articles. For example, the web may be impregnated with a latex and then creped, wherein a adhesion control additive comprising a semi-synthetic cationic polymer is applied to the creping drum or wherein semi-synthetic cationic polymer is present in the latex mixture. Specifically, the tissue web may be used for single or double print-creping as described in U.S. Pat. No. 3,879,257, "Absorbent Unitary Laminate-Like Fibrous Webs and Method for Producing Them," issued on Apr. 22, 1975 to Gentile et al., herein incorporated by reference to the extent that it is non-contradictory herewith. The tissue web may also be treated with wet strength resins on one side prior to contacting a Yankee dryer, wherein the wet strength resin assists in creping and provides improved temporary wet strength to the tissue web, as disclosed in U.S. Pat. No. 5,993,602, "Method of Applying Permanent Wet Strength Agents to Impart Temporary Wet Strength in Absorbent Tissue Structures," issued on Nov. 30, 1999 to Smith et al.

In one embodiment, the tissue webs of the present invention are laminated with additional plies of tissue or layers of nonwoven materials such as spunbond or meltblown webs, or other synthetic or natural materials. For example, in a cellulosic product containing two or more plies of tissue, such as bath tissue, a pair of plies such as the plies forming the opposing outer surfaces of the product may comprise any of the following: a creped and uncreped tissue web; a calendered and uncalendered tissue web; a tissue web comprising hydrophobic matter or sizing agents and a more hydrophobic tissue web; tissue webs of two differing basis weights; tissue webs of two differing embossment patterns; an embossed and unembossed tissue web; a tissue web with high wet strength; and a tissue web with low wet strength; a tissue web having syncline marks and a tissue web free of syncline marks; a tissue web with antimicrobial additives and a tissue web free of such additives; a tissue web with asymmetrical domes and one free of domes; a through-dried tissue web and a tissue web dried without use of a through-dryer; tissue webs of two different colors; an apertured tissue web and an unapertured tissue web; and, the like. Lamination can be achieved through crimping, perf-embossing, adhesive attachment, etc. The adhesive may comprise natural materials such as starch, gum arabic, and the like, or adhesives containing natural fibers, exemplified by U.S. Pat. No. 5,958,558, "Corrugating Adhesives Employing Tapioca Fiber," issued to J. E. T. Giesfeldt and J. R. Wallace on Sep. 28, 1999. The adhesives may also comprise semi-synthetic cationic polymers.

Laminates formed with the tissue webs of the present invention may be produced by any method known in the art, including lamination with thermoplastic adhesives to a film as disclosed in U.S. Pat. No. 5,958,178, issued on Sep. 28, 1999 to P. Bartsch and H. J. Mueller. The products made from the tissue webs of the present invention may be in roll form with or without a separate core, or may be in a substantially planar form such as a stack of facial tissues, or in any other form known in the art.

The tissue web may also be calendered, embossed, slit, rewet, moistened for use as a wet wipe, impregnated with thermoplastic material or resins, treated with hydrophobic matter, printed, apertured, perforated, converted to multiply assemblies, or converted to bath tissue, facial tissue, paper towels, wipers, absorbent articles, and the like.

The tissue webs of the present invention can be converted in any known tissue product suitable for consumer use. Converting can comprise calendering, embossing, slitting, printing, addition of perfume, addition of lotion or emollients or health care additives such as menthol, stacking preferably cut sheets for placement in a carton or production of rolls of finished product, and final packaging of the product, including wrapping with a poly film with suitable graphics printed thereon, or incorporation into other product forms.

Definitions and Test Methods

As used herein, "viscosity" is measured with a Sofrasser SA Viscometer (Villemandeur, France) connected to a type MIVI-6001 measurement panel. The viscometer employs a vibrating rod which responds to the viscosity of the surrounding fluid. To make the measurement, a 30 ml glass tube (Corex H No. 8445) supplied with the viscometer is filled with 10.7 ml of fluid and the tube is placed over the vibrating rod to immerse the rod in fluid. A steel guide around the rod receives the glass tube and allows the tube to be completely inserted into the device to allow the liquid depth over the vibrating rod to be reproducible. The tube is held in place for 30 seconds to allow the centipoise reading on the measurement panel to reach a stable value.

As used herein, a material is said to be "absorbent" if it can retain an amount of water equal to at least 100% of its dry weight as measured by the test for Intrinsic Absorbent Capacity given below (i.e., the material has an Intrinsic Absorbent Capacity of at about 1 or greater). For example, the absorbent materials used in the absorbent members of the present invention can have an Intrinsic Absorbent Capacity of about 2 or greater, more specifically about 4 or greater, more specifically still about 7 or greater, and more specifically still about 10 or greater, with exemplary ranges of from about 3 to about 30 or from about 4 to about 25 or from about 12 to about 40.

As used herein, "Intrinsic Absorbent Capacity" refers to the amount of water that a saturated sample can hold relative to the dry weight of the sample and is reported as a dimensionless number (mass divided by mass). The test is performed according to Federal Government Specification UU-T-595b. It is made by cutting a 10.16 cm long by 10.16 cm wide (4 inch long by 4 inch wide) test sample, weighing it, and then saturating it with water for three minutes by soaking. The sample is then removed from the water and hung by one corner for 30 seconds to allow excess water to be drained off. The sample is then re-weighed, and the difference between the wet and dry weights is the water pickup of the sample expressed in grams per 10.16 cm long by 10.16 cm wide sample. The Intrinsic Absorbent Capacity value is obtained by dividing the total water pick-up by the dry weight of the sample. If the material lacks adequate integrity when wet to perform the test without sample disintegration, the test method may be modified to provide improved integrity to the sample without substantially modifying its absorbent properties. Specifically, the material may be reinforced with up to 6 lines of hot melt adhesive having a diameter of about 1 mm applied to the outer surface of the article to encircle the material with a water-resistant band. The hot melt should be applied to avoid penetration of the adhesive into the body of the material being tested. The corner on which the sample is hung in particular should be reinforced with external hot melt adhesive to increase integrity if the untreated sample cannot be hung for 30 seconds when wet.

As used herein, "absorbent capacity" refers to the total mass of water that a specified quantity of absorbent material can hold, and is simply the Intrinsic Absorbent Capacity multiplied by the dry mass of the absorbent material. Thus 10 g of material having an Intrinsic Absorbent Capacity of 5 has an absorbent capacity of 50 g (or about 50 ml of fluid).

"Water retention value" (WRV), as used herein, is a measure that can be used to characterize some fibers useful for purposes of the present invention. WRV is measured by dispersing 0.5 gram of fibers in deionized water, soaking overnight, then centrifuging the fibers in a 4.83 cm (1.9 inch) diameter tube with an 0.15 mm (100 mesh) screen at the bottom at 1000 gravities for 20 minutes. The samples are weighed, then dried at 105° C. for two hours and then weighed again. WRV is (wet weight—dry weight)/dry weight. Fibers useful for purposes of this invention can have a WRV of about 0.7 or greater, more specifically from about 1 to about 2. High yield pulp fibers typically have a WRV of about 1 or greater.

"Papermaking fibers," as used herein, include all known cellulosic fibers or fiber mixes comprising cellulosic fibers. Fibers suitable for making the tissue webs of the present invention comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers can be prepared in high-yield or low-yield forms and may be pulped in any known method, including kraft, sulfite, high-yield pulping methods and other known pulping methods. Fibers prepared from organosolv pulping methods may also be used, including the fibers and methods disclosed in U.S. Pat. No. 4,793,898, issued on Dec. 27, 1988 to Laamanen et al.; U.S. Pat. No. 4,594,130, issued on Jun. 10, 1986 to Chang et al.; and, U.S. Pat. No. 3,585,104, issued on June 1971 to Kleinert. Useful fibers can also be produced by anthraquinone pulping, exemplified by U.S. Pat. No. 5,595,628, issued on Jan. 21, 1997 to Gordon et al. A portion of the fibers, such as up to 50% or less by dry weight, or from about 5% to about 30% by dry weight, may be synthetic fibers such as rayon, polyolefin fibers, polyester fibers, bicomponent sheath-core fibers, and the like. An exemplary polyethylene fiber is Pulpex®, available from Hercules, Inc. (Wilmington, Del.). Any known bleaching method may be used. Synthetic cellulose fiber types include rayon in all its varieties and other fibers derived from viscose or chemically modified cellulose. Chemically treated natural cellulosic fibers may be used such as mercerized pulps, chemically stiffened or crosslinked fibers, or sulfonated fibers. For good mechanical properties in using papermaking fibers, it may be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives may be used. Suitable papermaking fibers may also include recycled fibers, virgin fibers, or mixes thereof. In certain embodiments capable of high bulk and good compressive properties, the fibers may have a Canadian Standard Freeness of at least 200, more specifically at least 300, more specifically still at least 400, and most specifically at least 500.

As used herein, "high yield pulp fibers" are those papermaking fibers of pulps produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. High yield pulps include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which contain fibers having high levels of lignin. Characteristic high-yield fibers can have lignin content by mass of about 1% or greater, more specifically about 3% or greater, and still more specifically from about 2% to about 25%. Likewise, high yield fibers can have a kappa number greater than about 20, for example. In one embodiment, the high-yield fibers are predominately softwood, such as northern softwood or, more specifically, northern softwood BCTMP.

As used herein, the term "cellulosic" is meant to include any material having cellulose as a major constituent, and specifically comprising about 50 percent or more by weight of cellulose or cellulose derivatives. Thus, the term includes cotton, typical wood pulps, nonwoody cellulosic fibers, cellulose acetate, cellulose triacetate, rayon, viscose fibers, thermomechanical wood pulp, chemical wood pulp, debonded chemical wood pulp, lyocell and other fibers formed from solutions of cellulose in NMMO, milkweed, or bacterial cellulose, lyocell, and can be viscose, rayon, and the like. Fibers that have not been spun or regenerated from solution can be used exclusively, if desired, or at least about 80% of the tissue web can be free of spun fibers or fibers generated from a cellulose solution.

As used herein, the "wet:dry ratio" is the ratio of the geometric mean wet tensile strength divided by the geometric mean dry tensile strength. Geometric mean tensile strength (GMT) is the square root of the product of the machine direction tensile strength and the cross-machine direction tensile strength of the tissue web. Unless otherwise indicated, the term "tensile strength" means "geometric mean tensile strength." The absorbent tissue webs used in the present invention may have a wet:dry ratio of about 0.1 or greater and more specifically about 0.2 or greater. Tensile strength may be measured using an Instron tensile tester using a 3-inch jaw width (sample width), a jaw span of 2 inches (gauge length), and a crosshead speed of 25.4 centimeters per minute after maintaining the sample under TAPPI conditions for 4 hours before testing. The absorbent tissue webs of the present invention may have a minimum absolute ratio of dry tensile strength to basis weight of about 0.01 gram/gsm, specifically about 0.05 grams/gsm, more specifically about 0.2 grams/gsm, more specifically still about 1 gram/gsm and most specifically from about 2 grams/gsm to about 50 grams/gsm.

As used herein, the term "polymeric web" refers to a porous or nonporous layer primarily composed of polymeric material, and may be a nonwoven web, a plastic film, a polymeric film, an apertured film, or a layer of foam. Polymeric tissue webs may be used as wicking barriers, baffle layers, backsheets, and, if sufficiently liquid pervious, as topsheets of absorbent articles. A polymeric tissue web can consist of about 50 weight percent or more polymeric material, more specifically about 80 weight percent or more polymeric material, and most specifically about 90 weight percent or more polymeric material. Exemplary materials include polyolefins, polyesters, polyvinyl compounds, and polyamides.

As used herein, "bulk" and "density," unless otherwise specified, are based on an oven-dry mass of a sample and a thickness measurement made at a load of 0.34 kPa (0.05 psi) with a 7.62-cm (three-inch) diameter circular platen. Details for thickness measurements and other forms of bulk are described hereafter. As used herein, "Debonded Void Thickness" is a measure of the void volume at a microscopic level along a section of the tissue web, which may be used to discern the differences between densified and undensified portions of the tissue web or between portions that have been highly sheared and those that have been less sheared. The test method for measuring "Debonded Void Thickness" is described in U.S. Pat. No. 5,411,636, "Method for Increasing the Internal Bulk of Wet-Pressed Tissue," issued on May 2, 1995 to Hermans et al., herein incorporated by reference to the extent that it is non-contradictory herewith. Specifically, Debonded Void Thickness is the void area or space not occupied by fibers in a cross-section of the tissue web per unit length. It is a measure of internal web bulk (as distinguished from external bulk created by simply molding the web to the contour of the fabric). The "Normalized Debonded Void Thickness" is the Debonded Void Thickness divided by the weight of a circular, four inch diameter sample of the tissue web. The determination of these parameters is described in connection with FIGS. 8–13 of U.S. Pat. No. 5,411,636. Debonded Void Thickness reveal some aspects of asymmetrically imprinted or molded tissue web. For example, Debonded Void Thickness, when adapted for measurement of a short section of a protrusion of a molded tissue web by using a suitably short length of a cross-directional cross-section, may reveal that the leading side of a protrusion has a different degree of bonding than the trailing side, with average differences of about 10% or more or of about 30% or more being contemplated. As used herein, "elastic modulus" is a measure of slope of stress-strain of a tissue web taken during tensile testing thereof and is expressed in units of kilograms of force. Tappi conditioned samples with a width of 3 inches are placed in tensile tester jaws with a gauge length (span between jaws) of 2 inches. The jaws move apart at a crosshead speed of 25.4 cm/min and the slope is taken as the least squares fit of the data between stress values of 50 grams of force and 100 grams of force, or the least squares fit of the data between stress values of 100 grams of force and 200 grams of force, whichever is greater. If the sample is too weak to sustain a stress of at least 200 grams of force without failure, an additional ply is repeatedly added until the multi-ply sample can withstand at least 200 grams of force without failure.

As used herein, the term "hydrophobic" refers to a material having a contact angle of water in air of at least 90 degrees. In contrast, as used herein, the term "hydrophilic" refers to a material having a contact angle of water in air of less than 90 degrees.

As used herein, the term "surfactant" includes a single surfactant or a mixture of two or more surfactants. If a mixture of two or more surfactants is employed, the surfactants may be selected from the same or different classes, provided only that the surfactants present in the mixture are compatible with each other. In general, the surfactant can be any surfactant known to those having ordinary skill in the art, including anionic, cationic, nonionic and amphoteric surfactants. Examples of anionic surfactants include, among others, linear and branched-chain sodium alkylbenzenesulfonates; linear and branched-chain alkyl sulfates; linear and branched-chain alkyl ethoxy sulfates; and silicone phosphate esters, silicone sulfates, and silicone carboxylates such as those manufactured by Lambent Technologies, located in Norcross, Ga. Cationic surfactants include, by way of illustration, tallow trimethylammonium chloride and, more generally, silicone amides, silicone amido quaternary amines, and silicone imidazoline quaternary amines. Examples of nonionic surfactants, include, again by way of illustration only, alkyl polyethoxylates; polyethoxylated alkylphenols; fatty acid ethanol amides; dimethicone copolyol esters, dimethiconol esters, and dimethicone copolyols such as those manufactured by Lambent Technologies; and, complex polymers of ethylene oxide, propylene oxide, and alcohols. One exemplary class of amphoteric surfactants are the silicone amphoterics manufactured by Lambent Technologies (Norcross, Ga.).

As used herein, "softening agents," sometimes referred to as "debonders," can be used to enhance the softness of the tissue product and such softening agents can be incorporated with the fibers before, during or after disperging. Such agents can also be sprayed, printed, or coated onto the tissue web after formation, while wet, or added to the wet end of the tissue machine prior to formation. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di-hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

Debonder agents or "softening agents" can also be used in a drum drying additive to promote release of the tissue web from the drum surface. A balance of adhesive agents and release agents may be used when the tissue web is uncreped to provide suitable stability of the tissue web on the dry and good thermal contract of the tissue web to the dryer, while still permitting release from the dryer surface.

Preparation of Handsheets

To prepare a pulp slurry, 25 grams (oven-dry basis) of pulp fibers are soaked for 24 hours. The wet pulp is placed in 2 liters of deionized water and then disintegrated for 5 minutes in a British disintegrator. The slurry is then diluted with deionized water to a volume of 8 liters. From 900 ml to 1000 ml of the diluted slurry, measured in a graduated cylinder, was then poured into an 8.5-inch by 8.5-inch Valley handsheet mold (Valley Laboratory Equipment, Voith, Inc.) that was half-filled with water. After pouring slurry into the mold, the mold was then completely filled with water, including water used to rinse the graduated cylinder. The slurry was then agitated gently with a standard perforated mixing plate that was inserted into the slurry and moved up and down seven times, then removed. The water was then drained from the mold through a wire assembly at the bottom of the mold which retains the fibers to form an embryonic tissue web. The forming wire is a 90×90 mesh, stainless-steel wire cloth. The tissue web is couched from the mold wire with two blotter papers placed on top of the tissue web with the smooth side of the blotter contacting the tissue web. The blotters are removed and the embryonic tissue web is lifted with the lower blotter paper, to which it is attached. The lower blotter is separated from the other blotter, keeping the embryonic tissue web attached to the lower blotter. The blotter is positioned with the embryonic tissue web face up, and the blotter is placed on top of two other dry blotters. Two more dry blotters are also placed on top of the embryonic tissue web. The stack of blotters with the embryonic tissue web is placed in a Valley hydraulic press and pressed for one minute with 75 psi applied to the tissue web. The pressed tissue web was removed from the blotters and placed on a Valley steam dryer containing steam at 2.5 psig pressure and heated for 2 minutes, with the wire-side surface of the tissue web next to the metal drying surface and a felt under tension on the opposite side of the tissue web. Felt tension was provided by a 17.5 lbs of weight pulling downward on an end of the felt that extends beyond the edge of the curved metal dryer surface. The dried handsheet is trimmed to 7.5 inches square with a paper cutter and then weighed in a heated balance with the temperature maintained at 105° C. to obtain the oven dry weight of the tissue web.

The percent consistency of the diluted pulp slurry from which the sheet was made was calculated by dividing the dry weight of the sheet by the initial volume (in terms of milliliters, ranging from 900 to 1000) and multiplying the quotient by 100. Based on the resulting percent consistency value, the volume of pulp slurry necessary to give a target sheet basis weight of 60 gsm (or other target value) was calculated. The calculated volume of diluted pulp was used to make additional handsheets.

Handsheet Tensile Tests

Handsheet testing is done under laboratory conditions of 23.0+/−1.0° C., 50.0+/−2.0% relative humidity, after the sheet has equilibrated to the testing conditions for four hours. The testing is done on a tensile testing machine maintaining a constant rate of elongation, and the width of each specimen tested was 1 inch. The specimen were cut into strips having a 1±0.04 inch width using a precision cutter. The "jaw span" or the distance between the jaws, sometimes referred to as gauge length, is 5.0 inches. The crosshead speed is 0.5 inches per minute (12.5 mm/min.) A load cell is chosen so that peak load results generally fall between about 20 and about 80 percent of the full scale load (e.g., a 100N load cell). Suitable tensile testing machines include those such as the Sintech QAD IMAP integrated testing system or an MTS Alliance RT/1 universal test machine with TestWorks 4 software. This data system records at least 20 load and elongation points per second.

Handsheet Wet Tensile Strength

For wet tensile measurement, distilled water is poured into a container to a depth of approximately ¾ of an inch. An open loop was formed by holding each end of a test specimen and carefully lowering the specimen until the lowermost curve of the loop touches the surface of the water without allowing the inner side of the loop to come together. The lowermost point of the curve on the handsheet is contacted with the surface of the distilled water in such a way that the wetted area on the inside of the loop extends at least 1 inch and not more than 1.5 inches lengthwise on the specimen and is uniform across the width of the specimen. Care was taken to not wet each specimen more than once or allow the opposite sides of the loop to touch each other or the sides of the container. Excess water was removed from the test specimen by lightly touching the wetted area to a blotter. Each specimen was blotted only once. Each specimen is then immediately inserted into the tensile tester so that the jaws are clamped to the dry area of the test specimen with the wet area approximately midway between the span. The test specimen are tested under the same instrument conditions and using same calculations as for Dry Tensile Strength measurements.

Soluble Charge Testing

Soluble charge testing is done with an ECA 2100 Electrokinetic Charge Analyzer from ChemTrac (Norcross, Ga.). Titration is done with a Mettler DL21 Titrator using 0.001N DADMAC (diallyl dimethyl ammonium chloride) when the sample is anionic, or 0.001N PVSK (potassium polyvinyl sulphate) when the sample is cationic. 500 ml of the pulp slurry prepared for use in handsheet making (slurry having about 1.5 g of fibers) is dewatered on a Whatman No. 4 filter on a Buechner funnel. Approximately 150 ml of filtrate (the exact weight to 0.01 grams is recorded for soluble charge calculations) are withdrawn and used to complete the titration. The streaming potential (streaming current) of the filtrate is then measured after 5 to 10 minutes, once the reading has stabilized. The sign of the streaming potential is then used to determine which reagent to apply in titration. The titration is complete when the current reaches zero. Soluble charge is calculated using the titrant normality (0.001N), titrant volume consumed, and filtrate weight; soluble charge is reported in units of milliequivalents per liter (meq/L).

EXAMPLE 1

Raifix® 120 was demonstrated as a creping additive, both alone and in combination with other chemicals, in a trial conducted on a pilot tissue machine. More specifically, 45.5 pounds (oven dry basis) of eucalyptus hardwood kraft fiber and 24.5 pounds (oven dry basis) of northern softwood kraft fiber were dispersed in a pulper for 30 minutes at a consistency of 3 percent. The thick stock slurry was then passed to a machine chest and diluted to a consistency of 1 percent. Kymene 6500, a commercially available PAE wet strength resin from Hercules, Inc., was added to the pulp slurry in the machine chest at a rate of 4 pounds of dry chemical per ton of dry fiber. The stock was further diluted to approximately 0.1 percent consistency prior to forming and deposited from an unlayered headbox onto a fine forming fabric having a velocity of about 50 feet per minute to form a 17" wide tissue web. The flow rate of the slurry in the flow spreader was adjusted to give a target tissue web basis weight of 12.7 gsm. The slurry drained through the forming fabric, building an embryonic tissue web which was transferred to a second fabric, a papermaking felt, before being further dewatered with a vacuum box to a consistency of between about 15% to about 25%. The tissue web was then transferred via a pressure roll to a steam heated Yankee dryer operating at a temperature of 220° F. at a steam pressure of 17 PSI. The dried tissue web was then transferred to a reel traveling at a speed 30% less than the speed of the Yankee dryer to provide a crepe ratio of 1.3:1.

Creping compositions were prepared with different levels of Polyvinyl alcohol, PVOH, Celvol 523 manufactured by Celanese, 88% hydrolyzed with a viscosity of a 4% solution at 20° C. of between about 23 to about 27 cps., a commercially available PAE resin, Kymene 6500 from Hercules, Inc., a debonder/creping release agent, Quasoft 2008, manufactured by Hercules, Inc., and Raifix 120, a semi-synthetic cationic polymer. Compositions were prepared by adding the specific amount of each chemical shown in TABLE 1 to 10 gallons of water and mixing well. PVOH was obtained as a 6% aqueous solution, Kymene 557 as a 12.5% aqueous solution, Quaker 2008 as a 7% solution in IPA/water, and Raifix 120 as a 20% aqueous solution. The solution was then applied to the Yankee dryer surface via a spray boom at a pressure of 60 psi at a rate of approximately 0.25 g solids/$m^2$ of product.

TABLE 1

| | Grams PVOH | Grams Kymene 557 | Grams Quaker 2008 | Grams Raifix 120 | PVOH % Dry Solids | Kymene 557% Dry solids | Quaker 2008% Dry Solids | Raifix 120 % Dry solids |
|---|---|---|---|---|---|---|---|---|
| Code 1 | 2000 | 30 | 8 | 0 | 0.317% | 0.010% | 0.001% | 0.000% |
| Code 2 | 1000 | 30 | 8 | 300 | 0.159% | 0.010% | 0.001% | 0.159% |
| Code 3 | 0 | 0 | 0 | 600 | 0.000% | 0.000% | 0.000% | 0.317% |
| Code 4 | 1700 | 140 | 8 | 0 | 0.269% | 0.046% | 0.001% | 0.000% |
| Code 5 | 0 | 140 | 8 | 600 | 0.000% | 0.046% | 0.001% | 0.317% |
| Code 6 | 600 | 250 | 8 | 180 | 0.095% | 0.083% | 0.001% | 0.095% |

TABLE 2 below summarizes the tensile data taken from the unconverted basesheet. The tensile data indicates that the Raifix semi-synthetic polymers can be employed as useful creping aids. A significant change in dryer adhesion would be signaled by significant changes in MD/CD ratio as well as GMT and stretch. All numbers given in TABLE 2 indicate good creping adhesion when the semi-synthetic polymer replaced other creping aids.

TABLE 2

| | MD Dry Tensile | CD Dry Tensile | GMT | MD/CD | MD Stretch | CD Stretch |
|---|---|---|---|---|---|---|
| Code 1 | 1227 | 878 | 1038 | 1.40 | 27.1 | 4.7 |
| Code 2 | 1241 | 867 | 1037 | 1.43 | 27.3 | 4.6 |
| Code 3 | 1222 | 814 | 998 | 1.50 | 29.5 | 5.2 |
| Code 4 | 1117 | 743 | 910 | 1.50 | 28.8 | 4.9 |
| Code 5 | 1179 | 829 | 989 | 1.42 | 31.8 | 5.1 |
| Code 6 | 1373 | 858 | 1085 | 1.60 | 32.8 | 4.5 |

The shavings from the Yankee coater film were collected from the control run (Run 1) with PVOH but no semi-synthetic cationic polymer was present in the drum drying additive. The shavings exhibited properties typical of conventional creping aids, looking like a thin, highly creped film that was brittle and stiff. The shavings also had a yellowish tinge. However, in Run 2, when 50% of the PVOH was substituted with the semi-synthetic cationic polymer, the shavings had a soft, flexible feel and were unusually white in color. The shavings that could be collected were smaller in size and had less body than in Run 1, apparently because the low molecular weight of the semi-synthetic cationic polymer did not contribute substantially to the building of an integral polymeric film.

In Code 3, when semi-synthetic cationic polymer was the only polymer present in the drum drying additive, the shavings lacked integrity, being substantially in the form of powder, which is consistent with the low molecular weight of the semi-synthetic cationic polymer.

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

We claim:

1. A tissue web having a first side and a second side, the tissue web comprising cellulosic fibers and a semi-synthetic cationic polymer having a molecular weight of about 5 million or less and a degree of cationic substitution of from about 0.4 to about 0.8 wherein the first side of the tissue web has a substantially greater amount of the semi-synthetic cationic polymer present than does the second side of the web.

2. The tissue web of claim 1, wherein the tissue web has been creped from the surface of a drum dryer, and wherein the first side of the tissue web was in contact with the surface of the drum dryer, and wherein the first side of the tissue web has substantially more of the semi-synthetic cationic polymer than the second side.

3. The tissue web of claim 1, wherein the tissue web has been creped from a drying drum to which the tissue web was adhered with the aid of a drum drying additive comprising a semi-synthetic cationic polymer.

4. The tissue web of claim 1, wherein the semi-synthetic cationic polymer has been applied to the tissue web in a pattern.

5. The tissue web of claim 1, wherein the tissue web comprises at least two layers, and wherein a first layer of the at least two layers comprises a substantially greater percentage by weight of the semi-synthetic cationic polymer than at least one other layer of the at least two layers.

6. The tissue web of claim 5, wherein the weight percent of the semi-synthetic cationic polymer in a second layer is less than about half the weight percent of the semi-synthetic cationic polymer in the first layer.

7. The tissue web of claim 1, wherein the tissue web is not creped.

8. The tissue web of claim 1, wherein the semi-synthetic cationic polymer comprises a polysaccharide derived from a naturally occurring substance, the polysaccharide further having synthetically added cationic groups.

9. The tissue web of claim 8, wherein the cationic groups are selected from quaternary ammonium groups, primary amines, secondary amines, tertiary amines, aryl amines, and immonium groups.

10. The tissue web of claim 1, wherein the semi-synthetic cationic polymer comprises a nitrogen-containing cationic group.

11. The tissue web of claim 1, wherein the semi-synthetic cationic polymer comprises a cationic group selected from onium groups, isocyanates, choline, and betaine.

12. The tissue web of claim 1, wherein the cationic groups of the semi-synthetic cationic polymer are primarily quaternary ammonium groups.

13. The tissue web of claim 1, wherein the tissue web has been through-dried and imprinted against a drum dryer.

14. A creped tissue web comprising a semi-synthetic cationic polymer, the tissue web having been creped from a drum dryer to which a drum drying additive has been applied, the additive comprising a semi-synthetic cationic polymer comprising a plurality of anhydroglucose units and having from about 0.4 to about 0.8 cationic substituents per anhydroglucose unit, said drum drying additive containing from about 80% to about 99.9% water.

15. The tissue web of claim 14, wherein the drum drying additive further comprises at least 0.1% of an adhesion modifying polymer for modifying the adhesion of a tissue web to a drum dryer.

16. The tissue web of claim 15, wherein the drum drying additive comprises a polymer or copolymer having a plurality of monomeric units that each have at least one hydroxyl group.

17. The tissue web or claim 15, wherein the adhesion modifying polymer comprises at least one of a water-soluble polyamide-epihalohydrin resin, polyvinyl alcohol, and a copolymer of polyvinyl alcohol.

18. The tissue web of claim 14, wherein the drum drying additive further comprises a release agent.

19. The tissue web of claim 18, wherein the release agent comprises a silicone compound.

* * * * *